US006759988B2

(12) United States Patent
Purr et al.

(10) Patent No.: US 6,759,988 B2
(45) Date of Patent: Jul. 6, 2004

(54) MINIATURIZED DIRECTIONAL ANTENNA

(75) Inventors: Thomas Purr, Munich (DE); Rainer Pietig, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/254,250

(22) Filed: Sep. 25, 2002

(65) Prior Publication Data

US 2003/0063033 A1 Apr. 3, 2003

(30) Foreign Application Priority Data

Sep. 29, 2001 (DE) ..... 101 48 370

(51) Int. Cl.[7] ..... H01Q 1/38
(52) U.S. Cl. ..... 343/700 MS; 343/702
(58) Field of Search ..... 343/700 MS, 702, 343/829, 846

(56) References Cited

U.S. PATENT DOCUMENTS 5,936,593 A * 8/1999 Mandai et al. ..... 343/895
6,549,167 B1 * 4/2003 Yoon ..... 343/700 MS
6,614,400 B2 * 9/2003 Egorov ..... 343/702
2002/0067312 A1 * 6/2002 Hilgers ..... 343/700 MS
2003/0043081 A1 * 3/2003 Achim ..... 343/702

FOREIGN PATENT DOCUMENTS

EP 0790663 A1 8/1997 ..... H01Q/1/24
WO WO0054367 9/2000 ..... H03Q/1/24

OTHER PUBLICATIONS

Patent Abstracts of Japan, Nagumo Shoji: "Surface Mount Antenna And Communication Apparatus Using The Same" Publication No. 11004113, Jun. 1, 1999, Application No. 10081335, Mar. 27, 1998.

* cited by examiner

*Primary Examiner*—Tho Phan

(57) ABSTRACT

A description is given of a miniaturized directional antenna with a ceramic substrate (2) having at least one resonant printed wiring structure (3, 4, 5), in particular for use in the high-frequency and microwave ranges, which antenna is particularly suitable in that an electrically conductive motherboard (1, 11) is provided on which the substrate is arranged, while the at least one printed wiring structure (3, 4, 5) extends with one end as far as the motherboard. A radiation characteristic directed largely only in a half-space is achieved thereby.

20 Claims, 2 Drawing Sheets

MINIATURIZED DIRECTIONAL ANTENNA

The invention concerns a miniaturized directional antenna with a ceramic substrate having at least one resonant printed wiring structure, in particular for use in the high-frequency and microwave ranges. The invention also concerns a printed circuit board (PCB) for the surface mounting of electrical and/or electronic components (SMD—Surface-Mounted Devices) with an antenna of this kind.

Wireless radio networking is experiencing a steadily growing importance in modern telecommunications and, to an increasing extent, in entertainment electronics. Electromagnetic waves in the high-frequency and microwave ranges are used for the transmission of information. Examples of this are the mobile radio bands, which in Europe lie in the range between approximately 880 and 960 MHz (GSM 900) and between approximately 1710 and 1880 MHz (DCS 1800) and approximately 1850 and 1990 MHz (PCS 1900), the GPS navigation signals, which are emitted in a frequency band at approximately 1573 MHz, and the Bluetooth band in the frequency range between approximately 2400 MHz and 2500 MHz, which is used for the exchange of data between individual terminals.

The electronic components used for this purpose are subjected to ever higher requirements, in particular as regards their degree of miniaturization, their cost-effective mounting capability and their electrical efficiency. In the field of antennae, examples of the additional requirements imposed for their use in future mobile telephones are: internal locationing, multiband capability and reduced user irradiation and/or improved SAR (Specific Absorption Rate) values.

Conventional antennae for use in mobile telephones, such as external monopolar antennae or internal PIFA (Planar Inverted F Antenna) on dielectric substrates, fail to meet the above requirements, or meet them inadequately.

From JP-07 240 962 is known, for example, an antenna for mounting on a PCB which is equipped with ground plating and mounted in a mobile communications device in such a way that the ground plating lies between the user's body and the radiation path of the emitted waves in order to achieve a screening effect by this means. In order to achieve adequate reception sensitivity, however, a separate rod antenna is needed.

It is an object of the invention, therefore, to produce an antenna of the type specified above that is equipped with an increased efficiency and an improved directional characteristic in a preferred direction.

Furthermore, an antenna of the type specified above is to be produced, in which impedance matching can be undertaken in a relatively simple manner.

An antenna of the type specified above, with which a relatively large bandwidth can be achieved, is also to be produced with the invention.

Finally, an antenna of the type specified above that is suitable for use in several of the above-specified frequency bands (multiband capability) is also to be produced.

Finally, a PCB with an antenna of the type specified above, with which the above-mentioned objectives can be especially well achieved, is also to be produced with the invention.

In one embodiment of the invention, a directional antenna with a ceramic substrate having at least one resonant printed wiring structure, is arranged on an electrically conductive motherboard with one end of the at least one printed wiring structure coupled to the motherboard.

A significant advantage of this solution consists in the fact that, with this antenna, a radiation characteristic directed largely only into a half-space can be achieved, end thereby the irradiation with electromagnetic waves of, for example, the user of a mobile telephone in which this antenna is incorporated can be significantly reduced.

The advantageous further features of the invention include:

- through the suitable selection of the height of the substrate, a desired bandwidth of the antenna can be achieved;
- a particularly high degree of miniaturization can be achieved;
- impedance matching can be undertaken in a simple manner by changing the lead-in and thereby the capacitive coupling; and
- the antenna according to the invention can be executed as part of a printed circuit board.

The invention will be further described with reference to examples of embodiments shown in the drawings to which, however, the invention is not restricted.

Figure 1:
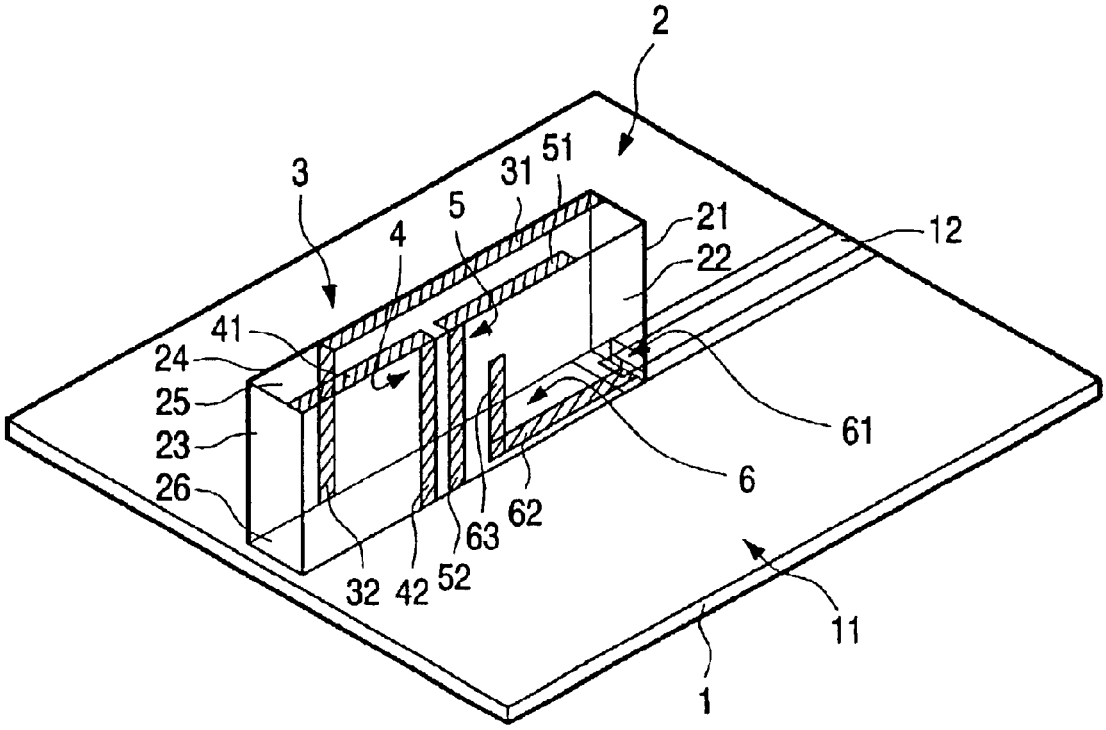
FIG. 1 shows a schematic overall view of an antenna according to the invention.

The antenna according to the invention comprises an electrically conductive motherboard which, according to FIG. 1 for example, is formed by a conventional board 1 (carrier) with plating 11, and a ceramic substrate 2 secured to this, which substrate is equipped with several resonant printed wiring structures 3, 4, 5 and a lead-in 6. The plating 11, which is located on the surface of the board 1 that is uppermost in the representation, preferably covers this surface completely, being left open only where a printed wiring 12 is arranged to feed the lead-in 6. The substrate 2 is mounted on the board 1 or the plating 11, e.g. with spot welds (not shown). It is shown as transparent to clarify the layout of the conductor-track structures.

The ceramic substrate 2 essentially has the shape of an upright cuboid with a first to a fourth side face 21, 22, 23, 24, running vertically in relation to the plane of board 1, a top side 25 and a bottom side 26. Instead of this cuboidal substrate, however, other geometrical shapes, such as square, round, triangular or polygonal cylindrical shapes, with or without cavities in each case, can also be selected, on which substrate the resonant printed wiring structures, running e.g. spirally, are placed.

The substrate 2 has a dielectric constant of $\in_r>1$ and/or a relative permeability of $\mu_r \geqq 1$. Typical materials are high-frequency-compatible substrates with low losses and low temperature sensitivity of the high-frequency characteristics (NP0 or so-called SL materials). Substrates whose dielectric constants and/or relative permeability can be adjusted by embedding a ceramic powder in a polymer matrix in a desired manner may also be used.

The printed wiring structures 3 to 5, the lead-in 6 and the other platings 11, 12 are produced primarily from highly electrically conductive materials such as silver, copper, gold, aluminum or a superconductor.

In detail, the following are located on substrate 2: the first printed wiring structure 3, which is composed of a first printed wiring 31 on the top side 25 and a second printed wiring 32, connected to it and running essentially at right angles to it downwards as far as the plating 11, on the fourth side face 24 of substrate 2. The second printed wiring structure 4 comprises a first printed wiring 41 on the top side 25 and a second printed wiring 42, connected to it and running essentially at right angles to it downwards as far as the plating 11, on the second side face 22 of substrate 2. The third printed wiring structure 5 is, finally, composed in turn of a first printed wiring 51 on the top side 25 and a second printed wiring 52, connected to it and running essentially at right angles to it downwards as far as the plating 11, on the second side face 22 of substrate 2. The second printed wirings 32, 42, 52 are each preferably bonded to the plating 11 by soldering or by other means.

The printed wiring structures 3, 4 and 5 are fed via a lead-in 6, which begins with a plating lamina 61 on the lower edge of the first side face 21, extends a short way on the bottom side 26 of substrate 2, and is soldered onto the coplanar printed wiring 12 on board 1. Connected to the plating lamina 61 is a first printed wiring 62, which runs along the second side face 22 in the area of its edge with bottom side 26 until it is joined at right angles by a second printed wiring 63, which extends a short way along the second side face 22 in the direction of the top side 25.

The printed wiring structures 3, 4 and 5 are fed in capacitive manner via the lead-in 6, while impedance matching can be achieved via the distance of this lead-in 6 from the printed wiring structures 3, 4 and 5 and thereby essentially via the length of the first and second printed wirings 62, 63. This coupling and thereby the impedance matching can also be undertaken with the antenna in its installed state by shortening the length of the second printed wiring 63, e.g. with a laser beam.

The electrical principle of the antenna is based on the excitation of the quarter-wavelength resonances on each of the essentially L-shaped printed wiring structures 3, 4 and 5, their lengths being calculated in accordance with the desired resonant frequency, taking account of the dielectric constant and/or the relative permeability of the substrate material.

The component of the electrical field running at right angles to the plating 11 along each of the second (vertical) printed wirings 32, 42, 52 thereby reduces in each case from its maximum value on the top side 25 to approximately a value of 0 on the plating 11.

The bandwidth of the antenna can be affected by changing the level of the substrate 2. The applicable relationship is that the bandwidth becomes greater as the level of the substrate increases, i.e. the greater the distance of the first printed wirings 31, 41, 51 from the plating 11.

Since a resonant frequency can be generated with each of the printed wiring structures 3, 4, 5, a desired number of resonant frequencies, and thereby a multiband capability, can be achieved by applying a corresponding number of printed wiring structures according to the above description. In the embodiment shown in FIG. 1, the first, longer printed wiring structure 3 serves to excite a resonance in the GSM 900 band, while the two shorter, i.e. the second and third printed wiring structures 4, 5, serve to excite resonances in higher frequency bands, such as the DCS 1800 and the PCS 1900 bands.

Figure 2:
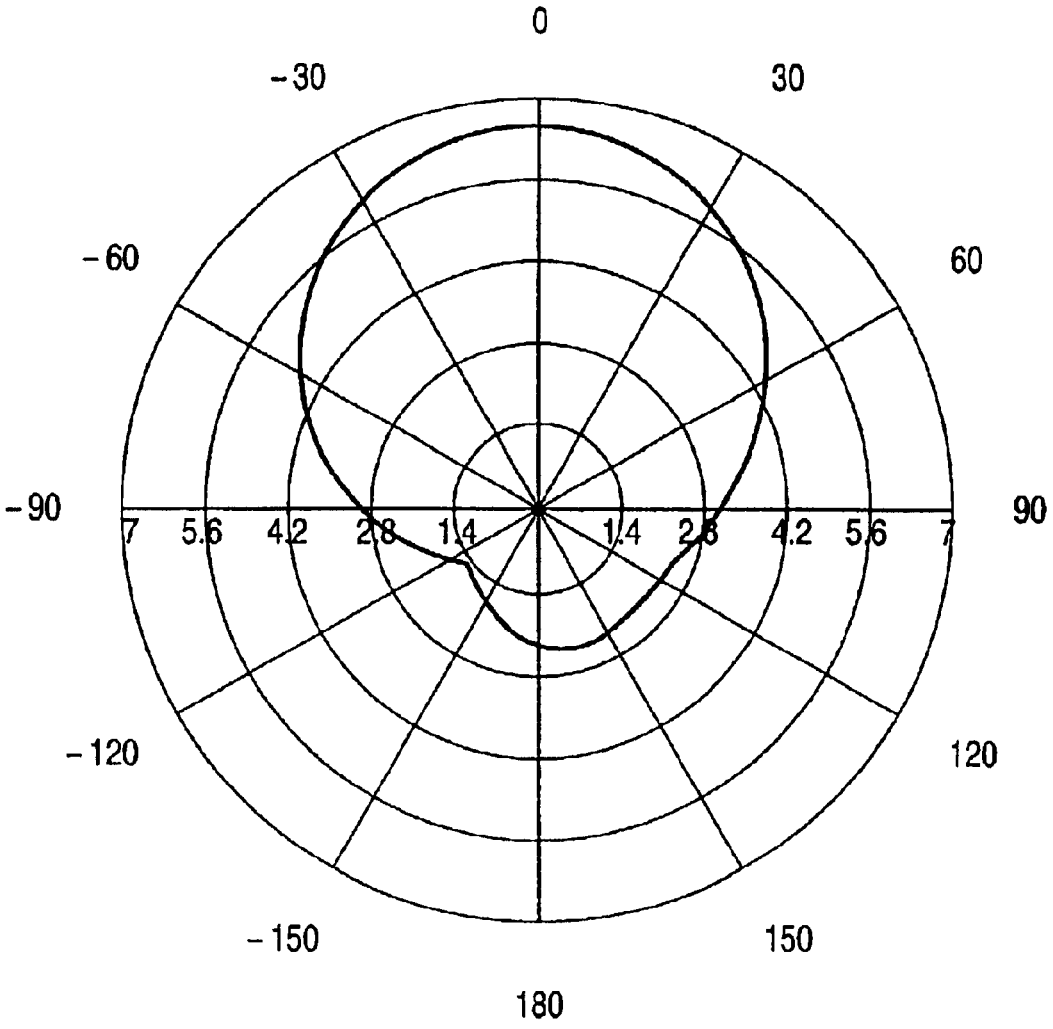
FIG. 2 shows a radiation pattern of the distant field of the antenna shown in FIG. 1.

The desired directional efficiency of the antenna in a half-space is effected by the plating 11 on the board 1. FIG. 2 shows a section (at $\phi=0$) through the directional diagram of the distant field of the antenna shown in FIG. 1, while the value of the electrical field strength in the distant field forms an essentially spherical diagram in the half-space above the plating 11 shown in FIG. 1. The plating 11, serving as a reflector or screening, was located on a conventional printed circuit board, where the plating occupied an area of approximately 90×35 $mm^2$ and the substrate was 24 mm long, 4 mm wide and 10 mm high. The antenna was operated inter alia in the frequency range at approximately 900 MHz.

The antenna according to the invention is preferably realized as part of, or in an area of, a PCB, which, apart from the plating 11, carries further electrical and/or electronic components, e.g. for a mobile telecommunications device of the above-mentioned type.

What is claimed is:

1. A directional antenna comprising:

an electrically conductive carrier plate;

a substrate, mounted on the carrier plate, that includes a top surface at a height that is measured as a distance from the carrier plate;

at least one printed wiring structure that includes:

a first printed wiring on the top surface having a length and a width, the width of the first printed wiring being substantially shorter than the length, and a second printed wiring that couples the first printed wiring structure to the electrically conductive carrier plate;

a lead-in printed wiring structure that is configured to provide a signal to the printed wiring structure via a capacitive coupling with the printed wiring structure;

wherein the height of the first printed wiring on the top surface from the carrier plate is substantially larger than the width of the first printed wiring, to provide a directional radiation pattern relative to the carrier plate.

2. The antenna of claim 1, wherein the length of the first printed wiring is substantially determined by a quarter-wavelength of a resonant frequency.

3. The antenna of claim 1, wherein the height of the first printed wiring substantially determines a bandwidth of the antenna at a resonant frequency.

4. The antenna of claim 1, wherein the height of the first printed wiring is at least five times greater than the width of the first printed wiring.

5. The antenna of claim 1, wherein the substrate has a depth that is substantially less than the height.

6. The antenna of claim 1, wherein the carrier plate corresponds to a plated area on a printed circuit board.

7. The antenna of claim 1, further including at least one other printed wiring structure that each include:

a corresponding first printed wiring on the top surface, and a corresponding second printed wiring that couples the corresponding first printed wiring structure to the electrically conductive carrier plate;

wherein the lead-in printed wiring structure is also configured to provide the signal to each of the at least one other printed wiring structures via a capacitive coupling with each of the at least one other printed wiring structures.

8. The antenna of claim 7, wherein resonant frequencies of the printed wiring structure and the at least one other printing wiring structure includes at least two of:

a resonant frequency in a GSM 900 band;

a resonant frequency in a DCS 1800 band; and a resonant frequency in a PCS 1900 band.

9. The antenna of claim 1, wherein the lead-in printed wiring structure has a size that determines a characteristic impedance of the antenna.

10. The antenna of claim 1, wherein the lead-in printed wiring structure provides the capacitive coupling substantially via the second printed wiring.

11. The antenna of claim 1, wherein the substrate has at least one of:

a dielectric constant greater than one, and a relative permeability of at least one.

12. The antenna of claim 1, wherein the substrate includes ceramic material.

13. A communications device comprising:

a printed circuit board that includes an electrically conductive carrier plate;

a substrate, mounted on the carrier plate, that includes a top surface at a height that is measured as a distance from the carrier plate;

at least one printed wiring structure that forms a directional antenna with the carrier plate, and includes:

a first printed wiring on the top surface having a length and a width, the width of the first printed wiring being substantially shorter than the length, and a second printed wiring that couples the first printed wiring structure to the electrically conductive carrier plate;

a lead-in printed wiring structure that is configured to provide a signal to the printed wiring structure via a capacitive coupling with the printed wiring structure;

wherein the height of the first printed wiring on the top surface from the carrier plate is substantially larger than the width of the first printed wiring, to provide a directional radiation pattern relative to the carrier plate.

14. The communications device of claim 13, wherein the length of the first printed wiring is substantially determined based on a quarter-wavelength of an operating frequency of the communications device.

15. The communications device of claim 13, wherein the height of the first printed wiring is at least five times greater than the width of the first printed wiring.

16. The communications device of claim 13, wherein a surface area of the carrier plate is substantially larger than a surface area of the first printed wiring.

17. The communications device of claim 13, further including at least one other printed wiring structure that each include:

a corresponding first printed wiring on the top surface, and a corresponding second printed wiring that couples the corresponding first printed wiring structure to the electrically conductive carrier plate;

wherein the lead-in printed wiring structure is also configured to provide the signal to each of the at least one other printed wiring structures via a capacitive coupling with each of the at least one other printed wiring structures.

18. The communications device of claim 17, wherein the communications device is configured to operate in at least two of:

a GSM 900 band;

a DCS 1800 band; and a PCS 1900 band.

19. The communications device of claim 13, wherein the lead-in printed wiring structure provides the capacitive coupling substantially via the second printed wiring.

20. The communications device of claim 13, wherein the substrate includes ceramic material.

* * * * *